US008579263B2

(12) United States Patent
Petta

(10) Patent No.: US 8,579,263 B2
(45) Date of Patent: Nov. 12, 2013

(54) ADJUSTABLE BALUSTER ASSEMBLY

(75) Inventor: Gabriel Petta, Woodbridge (CA)

(73) Assignee: Alpa Lumber Inc., Mississauga (CA)

( * ) Notice: Subject to any disclaimer, the term of this patent is extended or adjusted under 35 U.S.C. 154(b) by 294 days.

(21) Appl. No.: 12/966,600

(22) Filed: Dec. 13, 2010

(65) Prior Publication Data

US 2011/0140062 A1 Jun. 16, 2011

(30) Foreign Application Priority Data

Dec. 11, 2009 (CA) ..... 2687404

(51) Int. Cl.
*E04H 17/14* (2006.01)

(52) U.S. Cl.
USPC ..... 256/67; 256/24; 256/59

(58) Field of Classification Search
USPC ..... 256/19, 24, 59, 65.01, 65.02, 67, 73; 403/64, 96, 99, 101, 113, 119, 169, 403/170, 174, 178, 217–219, 330; 135/151, 135/159; 24/453, 458; 411/388
See application file for complete search history.

(56) References Cited

U.S. PATENT DOCUMENTS 425,290 A * 4/1890 Boughton ..... 160/231.1
1,071,722 A * 9/1913 Fitzpatrick ..... 211/163
3,213,273 A * 10/1965 Zagel ..... 362/431
3,877,824 A * 4/1975 Jury ..... 403/174
4,272,061 A 6/1981 Suckno
4,846,842 A * 7/1989 Connolly et al. ..... 623/43
4,970,751 A * 11/1990 Fisher et al. ..... 15/250.32
5,056,283 A * 10/1991 Sapinski ..... 52/184
5,078,367 A * 1/1992 Simpson et al. ..... 256/24
5,572,845 A * 11/1996 DeSouza ..... 52/664
5,620,272 A * 4/1997 Sheng ..... 403/96
5,765,248 A * 6/1998 Ono ..... 14/75
6,056,240 A * 5/2000 Hagenlocher ..... 244/125
D427,322 S * 6/2000 DeSouza ..... D25/38
6,095,713 A * 8/2000 Doyle et al. ..... 403/97
6,161,359 A * 12/2000 Ono ..... 52/651.1
6,378,265 B1 * 4/2002 Konstandt ..... 52/655.2
6,581,896 B1 * 6/2003 Olexovitch ..... 248/534
6,629,801 B2 * 10/2003 Cheng ..... 403/101
6,776,179 B1 * 8/2004 Chen ..... 135/147
6,854,196 B2 * 2/2005 Burrell et al. ..... 33/558.02
D603,527 S * 11/2009 Steverson ..... D25/38
2002/0020834 A1 * 2/2002 Stusser ..... 256/24

FOREIGN PATENT DOCUMENTS

GB 2272006 5/1994

* cited by examiner

*Primary Examiner* — Gregory Binda
*Assistant Examiner* — Nahid Amiri
(74) *Attorney, Agent, or Firm* — Bereskin & Parr LLP/S.E.N.C.R.L., s.r.l.

(57) ABSTRACT

An adjustable baluster assembly for mounting in a fence section comprises a first baluster and a second baluster. The first baluster is mounted to the second baluster such that an angle of the first baluster with respect to the second baluster is adjustable. A method for assembling a fence section comprises providing an adjustable baluster assembly comprising a first baluster and a second baluster, adjusting an angle of the first baluster with respect to the second baluster, and mounting the baluster assembly between a horizontally extending upper rail of the fence section and a horizontally extending lower rail of the fence section.

25 Claims, 10 Drawing Sheets

100
104
114, 120
108
118
122
124
111
132
130
115
117
128
113
126
119
106
112
110
102

161
165
163
167
169

101
105
107
103
109
116

ADJUSTABLE BALUSTER ASSEMBLY

This application claims the benefit of Canadian Application No. 2,687,404, filed Dec. 11, 2009, which is hereby incorporated herein by reference.

FIELD

The teaching disclosed herein relates to baluster assemblies, and to one or more adjustable baluster assemblies or parts thereof which may be mounted in a fence section, and to one or more methods of making or using baluster assemblies or parts thereof.

INTRODUCTION

U.S. Pat. No. 4,272,061 (Suckno) discloses a variable pitch rail system. The system comprises a hand rail and shoe rail having channels running longitudinally therein. A plurality of balusters are connected between the hand rail and shoe rail by means of pivot pins extending through the walls of the channel and a hole formed in each baluster. In this manner, the pitch of the baluster with respect to the hand rail and the shoe rail can be changed to accommodate the pitch of the staircase upon which the system is to be used. Once installed, the channel areas between adjacent balusters are filled and the hand rail and shoe rail is attached to a newel post.

SUMMARY

According to one aspect, an adjustable baluster assembly for mounting in a fence section is provided. The adjustable baluster assembly comprises a first baluster and a second baluster. The first baluster is adjustably coupled to the second baluster such that an angle of the first baluster with respect to the second baluster is adjustable.

The first baluster may be connected to the second baluster by a joint member. The joint member may comprise a first joint section fixed to the first baluster, and a second joint section fixed to the second baluster. The first joint section may be adjustably connected to the second joint section. For example, the second joint section may be pivotally mounted to the first joint section. The first joint section and second joint section may be substantially identical to each other.

The first joint section may comprise a first hub having a first socket, and the second joint section may comprise a second hub having a second socket aligned with the first socket. A pivot pin may be mounted between the first socket and the second socket. The pivot pin may define a pivot axis. The first joint section may be pivotal relative to the second joint section about the pivot axis.

The first joint section may further comprise a first blade extending from the first hub in a direction perpendicular to the pivot axis, and the second joint section may further comprise a second blade extending from the second hub in a direction perpendicular to the pivot axis. The first baluster may be mounted to the first blade, and the second baluster may be mounted to the second blade. For example, the first baluster may be slidably receivable on the first blade and frictionally secured thereto, and the second baluster may be slidably receivable on the second blade and frictionally secured thereto.

A third baluster may be mounted to the first baluster and the second baluster such that an angle of the third baluster with respect to at least one of the first baluster and the second baluster is adjustable. A fourth baluster may be mounted to the first baluster and the second baluster such that an angle of the fourth baluster with respect to at least one of the first baluster and the second baluster is adjustable. The first, second, third, and fourth balusters may each be pivotably adjustable about a common pivot axis. The third baluster may fixedly positioned with respect to the first baluster the fourth baluster may be fixedly positioned with respect to the second baluster.

The first, second, third and fourth balusters may be pivotally mounted together by a joint member. The joint member may comprise a first joint section comprising a first hub having a first socket, a first blade extending from the first hub perpendicular to the pivot axis, and a third blade extending from the first hub opposite the first blade and perpendicular to the pivot axis. The joint member may further comprise a second joint section comprising a second hub having a second socket aligned with the first socket, a second blade extending from the second joint section central section perpendicular to the pivot axis, and a fourth blade extending from the second joint section hub opposite the second blade and pivot axis. A pivot pin may be received in the first joint section socket and the second joint section socket. The pivot pin may extend along the pivot axis and couple together the first and second joint sections. The first baluster may be slidably receivable on the first blade, the second baluster may be slidably receivable on the second blade, the third baluster may be slidably receivable on the third blade, and the fourth baluster may be slidably receivable on the fourth blade.

The first blade and the third blade may be provided on opposed sides of the first joint section central section and may be co-linear. The second blade and the fourth blade may be provided on opposed sides of the second joint section central section and may be co-linear.

The first baluster and second baluster may be connected by a pivot joint member, and each may comprise a first end proximate the pivot joint member and an opposed second end. The second ends may each be mountable to a horizontally extending fence rail.

The first baluster may have a first baluster front face and a first baluster rear face. The second baluster may have a second baluster front face generally coplanar with the first baluster front face, and a second baluster rear face coplanar with the first baluster rear face.

The first and second balusters may be manufactured by extrusion of a plastic.

According to another aspect, a fence section is provided. The fence section comprises a horizontally extending upper rail, and a horizontally extending lower rail. At least one adjustable baluster assembly is between the upper rail and the lower rail and is mounted to the upper rail and the lower rail. The adjustable baluster assembly comprises at least a first baluster and a second baluster. The first baluster is mounted to the second baluster such that an angle of the first baluster with respect to the second baluster is adjustable.

The first baluster may be adjustable about an axis, and the axis may extend horizontally and perpendicularly to the upper rail and lower rail. The axis may be vertically positioned approximately centrally between the upper rail and the lower rail.

The first baluster may be mounted to the second baluster by a joint member. The joint member may comprise a first joint section coupled to the first baluster, and a second joint section coupled to the second baluster and adjustably mounted to the first mount section. The second joint section may be pivotally mounted to the first joint section.

The first joint section and second joint section may be molded from a common mold.

The first joint section may comprise a first hub having a first socket, and the second joint section may comprise a second hub having a second socket aligned with the first socket. A pivot pin may be mounted in the first socket and the second socket to adjustably mount the first joint section to the second joint section.

The first joint section may further comprise a first blade extending from the first hub in a direction perpendicular to the first socket. The second joint section may further comprise a second blade extending from the second hub in a direction perpendicular to the second socket. The first baluster may mounted to the first blade, and the second baluster may be mounted to the second blade. For example, the first baluster may be slidably receivable on the first blade and frictionally secured thereto, and the second baluster may be slidably receivable on the second blade and frictionally secured thereto.

The fence section may further comprise a third baluster mounted to the first baluster and the second baluster such that an angle of the third baluster with respect to at least one of the first baluster and the second baluster is adjustable. The fence section may further comprise a fourth baluster mounted to the first baluster and the second baluster such that an angle of the fourth baluster with respect to at least one of the first baluster and the second baluster is adjustable. The first, second, third, and fourth balusters may each be adjustable about a common axis.

The third baluster may be fixedly positioned with respect to the first baluster and adjustably mounted with respect to the second baluster, and the fourth baluster may be fixedly positioned with respect to the second baluster and adjustably mounted with respect to the first baluster.

The first, second, third and fourth balusters may be pivotally mounted together by a joint member. The joint member may comprise a first joint section comprising a first hub having a first joint section socket, a first blade extending from the first hub perpendicular to the first socket, and a third blade extending from the first hub perpendicular to the first socket. The joint member may further comprise a second joint section comprising a second hub having a second socket aligned with the first socket, a second blade extending from the second hub perpendicular to the second socket, and a fourth blade extending from the second hub perpendicular to the second socket. A pivot pin may be received in the first socket and the second socket.

The first baluster may be slidably receivable on the first blade, the second baluster may be slidably receivable on the second blade, the third baluster may be slidably receivable on the third blade, and the fourth baluster may be slidably receivable on the fourth blade.

The first blade and the third blade may be provided on opposed sides of the first hub and may be co-linear, and the second blade and the fourth blade may be provided on opposed sides of the second hub and may be co-linear.

The first baluster may have a first baluster front face and a first baluster rear face. The second baluster may have a second baluster front face generally coplanar with the first baluster front face, and a second baluster rear face generally coplanar with the first baluster rear face.

The first and second balusters may be manufactured by extrusion of a plastic.

According to another aspect, a method for assembling a fence section is provided. The method comprises a) providing an adjustable baluster assembly comprising a first baluster and a second baluster; b) adjusting an angle of the first baluster with respect to the second baluster; and c) mounting the baluster assembly between a horizontally extending upper rail of the fence section and a horizontally extending lower rail of the fence section.

The method may further comprise adjusting a length of the first baluster and the second baluster.

The adjustable baluster assembly may comprise a third baluster and a fourth baluster mounted to the third baluster, and the method may further comprise adjusting an angle of the third baluster with respect to the fourth baluster.

Other aspects and features of the present specification will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. In the drawings.

Figure 15:
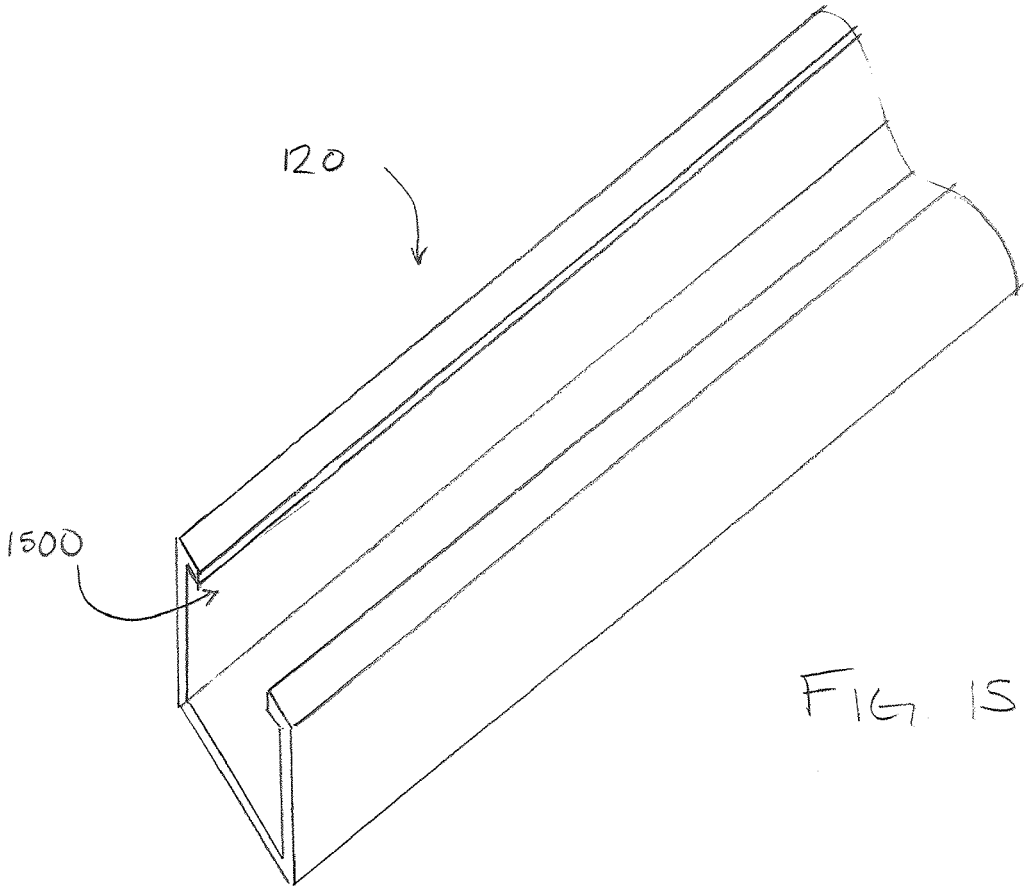

FIG. 15 s a partial perspective view of the lower rail of FIG. 1;

DETAILED DESCRIPTION

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Referring to FIG. 1, a fence section 100 is shown. The fence section 100 may be, for example, a section of an outdoor fence. Alternately, the fence section may be a section of a decorative rail. In the example shown, the fence section 100 comprises a lower section 102, and an upper section 104, and extends horizontally between first 106 and second 108 side posts or newel posts.

In the example shown, the lower section 102 comprises a fence panel 110, which has a horizontal and a vertical extent. The fence panel 110 may be of any suitable configuration. For example, as shown, the fence panel may comprise a plurality of vertically extending slats 112. The slats 112 may be individually formed, for example from wooden boards. Alternately, the slats 112 may be integrally formed. For example, the panel 110 may be formed from one or more plastic extrusions, each having a width and pattern giving the appearance of multiple slats across a single plastic panel member.

The panel 110 can have a top rail 114, and a bottom rail 116, which are vertically spaced apart and generally horizontally extending. The top rail 114 and the bottom rail 116 may be of any suitable configuration. For example, one or both of the top rail 114 and the bottom rail 116 may comprise a wooden member, or a plastic extrusion. The panel 110 may be mounted between the top rail 114 and the bottom rail 116 in any suitable fashion, for example using one or more fasteners (not shown). In alternate examples, the panel 110 may be integral with one or more of the top rail 114 and the bottom rail 116.

The upper section 104 comprises an upper rail 118 and a lower rail 120. In the example shown, the lower rail 120 of the upper section 104 is integrally formed in an upper portion the top rail 114 of the lower section 102. In other examples, the lower rail 120 and the top rail 114 can comprise separate elements. The upper section 104 further comprises a plurality of adjustable baluster assemblies 122. Each adjustable baluster assembly 122 is mounted in the fence section 100, between the upper rail 118 and the lower rail 120. As will be described in further detail hereinbelow, the adjustable baluster assemblies 122 are adjustable during assembly of the fence section 100, to fit a desired height and width and to provide a desired appearance.

In the example illustrated, each baluster assembly 122 comprises at least a first baluster 124 and a second baluster 126. In the example shown in FIGS. 1A to 1C, each baluster assembly 122 further comprises a third 128 and a fourth baluster 130. Each baluster 124, 126, 128 and 130 is generally elongate, extending along a respective baluster axis. The first baluster 124 is connected to the second baluster 126 such that an angle of the first baluster 124 with respect to the second baluster 126 is adjustable (i.e. the angle between the respective axes of the balusters 124 and 126 is adjustable). Further, in the example shown, the third baluster 128 is mounted to the fourth baluster 130 such that an angle of the third baluster 128 with respect to the fourth baluster 130 is adjustable. By adjusting the angle of the first baluster 124 with respect to the second baluster 126 (which, in the example illustrated causes a corresponding adjustment of the angle between the third and fourth balusters 128, 130), the overall height and width of the baluster assembly can be adjusted to fit a desired dimension of the upper section 104, and/or the appearance of the upper section 104 may be modified.

Figures 1A, 1B, 1C:
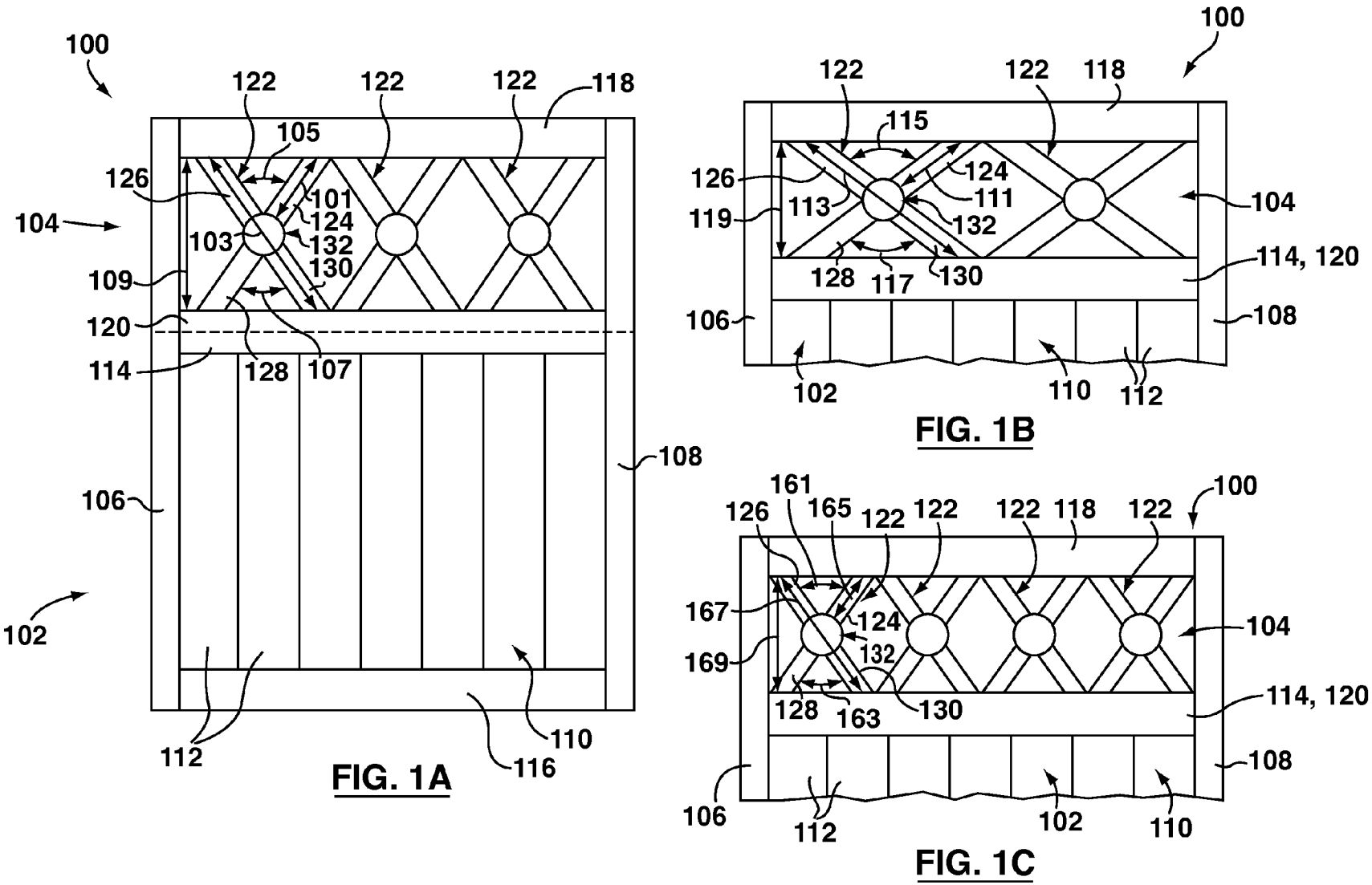
FIG. 1A is a front elevation view of a fence section comprising a plurality of exemplary adjustable baluster assemblies.
FIG. 1B is a front view of a portion of the fence section of FIG. 1A, showing the adjustable baluster assemblies in an adjusted configuration relative to FIG. 1A.
FIG. 1C is a front view of a portion of the fence section of FIG. 1A, showing the adjustable baluster assemblies in another adjusted configuration relative to FIGS. 1A and 1B.

For example, referring to FIG. 1A, each baluster has a first length 101, and a first distance 103 is defined between opposed ends of the first 124 and third 128 balusters, and the second 126 and fourth 130 balusters. The first baluster 124 is at a first angle 105 with respect to the second baluster 126, and the third baluster 128 is at a second angle 107 with respect to the fourth baluster 130. As shown, the second angle 107 is equal to the first angle 105. Further, in FIG. 1A, the baluster assemblies 122 have a first height 109.

Referring now to FIG. 1B, each baluster has a second length 111, and a second distance 113 is defined between opposed ends of the first 124 and third 128 balusters, and the second 126 and fourth 130 balusters. The second length 111 is equal to the first length 101, and the second distance 113 is equal to the first distance 103. However, the angle of the first baluster 124 with respect to the second baluster 126, as well as the angle of the third baluster 128 with respect to the fourth baluster 130, has been adjusted, so that the first baluster 124 is at a third angle 115 with respect to the second baluster 126, and the third baluster 128 is at a fourth angle 117 with respect to the fourth baluster 130. The fourth angle 117 is equal to the third angle 115, and both are greater than the first angle 105. Accordingly, as the second length 111 is equal to the first length 101 and the third 115 and fourth 117 angles are greater than the first angle 105, the baluster assembly 122 has a second height 119, which is less than the first height 109, and the overall height of the upper section 104 is decreased. Furthermore, the upper section 104 in FIG. 1B has a different appearance than the upper section 104 in FIG. 1A. Accordingly, the adjustable baluster assemblies 122 have been adjusted to fit the upper section 104 having a particular height and width, and to provide a particular appearance.

Alternately, as mentioned hereinabove, the adjustable baluster assemblies 122 may be adjusted to provide the upper section 104 with a particular appearance, without necessarily adjusting the height of the upper section 104. For example, referring now to FIG. 1C, the angle of the first baluster 124 with respect to the second baluster 126, and the angle of the third baluster 128 with respect to the fourth baluster 130 has been adjusted, so that the first baluster 124 is at a fifth angle 161 with respect to the second baluster 126, and the third baluster 128 is at a sixth angle 163 with respect to the fourth baluster 130. The fifth 161 and sixth 163 angles are equal to each other, and are less than the third angle 115.

In FIG. 1C, each baluster has a third length 165, which is less than the second length 111 in FIG. 1B. A third distance 167 is defined between opposed ends of the first 124 and third 128 balusters and the second 126 and fourth 130 balusters, which less than the second distance 113 in FIG. 1B. As the fifth 161 and sixth 163 angles are less than the third angle 115, and as the third distance 167 is less than the second distance 113, the baluster assembly 122 in FIG. 1C has a third height 169 that is the same as the second height 119 shown in FIG. 1B. However, the upper section 104 in FIG. 1C has a different appearance than the upper section in FIG. 1C. The width of the baluster assemblies in FIG. 1C is about half the width of the baluster assemblies in FIG. 1B.

In the examples shown, the balusters 124-130 are adjustable about axis 153 (shown in FIG. 2), which extends horizontally and perpendicular to the upper rail 118 and lower rail 120. In alternate examples, the axis 153 may be of an alternate orientation.

Although the first baluster 124 is described as being adjustably mounted to the second baluster 126, and the third baluster 128 is described as being adjustably mounted to the fourth baluster 130, it will be appreciated that in the example illustrated, adjusting the angle of the first baluster 124 with respect to the second baluster 126 causes a corresponding adjustment of the angle of the second baluster 126 with respect to the third baluster 128 and the angle of the first baluster 124 with respect to the fourth baluster 130.

Figure 2:
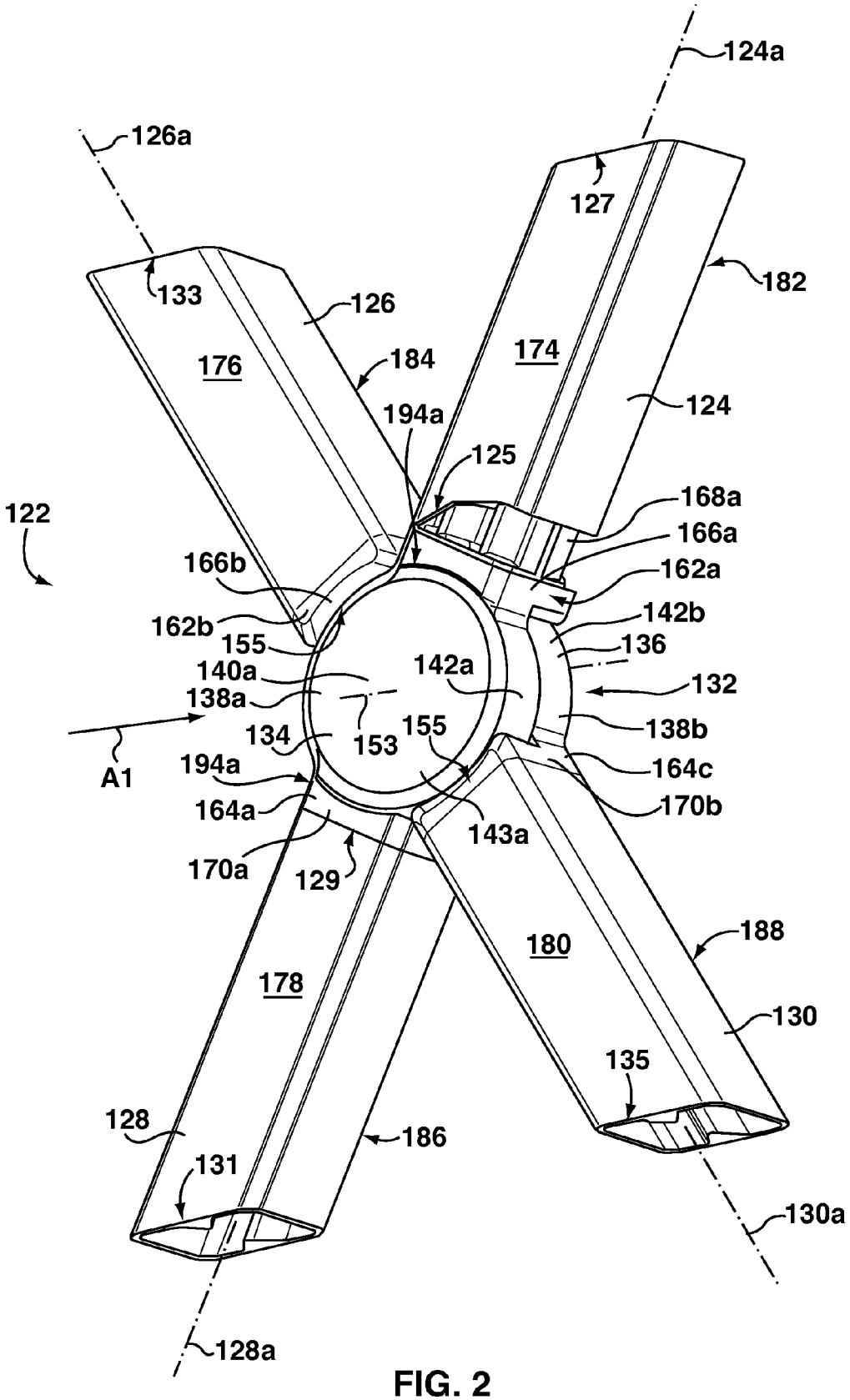
FIG. 2 is a perspective partial cutaway view of the adjustable baluster assembly of FIG. 1A.

Referring to FIG. 2, an exemplary baluster assembly 122 is shown. As mentioned hereinabove, the baluster assembly 122 comprises first 124, second 126, third 128, and fourth 130 balusters each extending along respective baluster axes 124*a*, 126*a*, 128*a* and 130*a*. The baluster assembly 122 further comprises a joint member 132, which adjustably connects the first baluster 124 to the second baluster 126, and the third baluster 128 to the fourth baluster 130.

Figure 3:
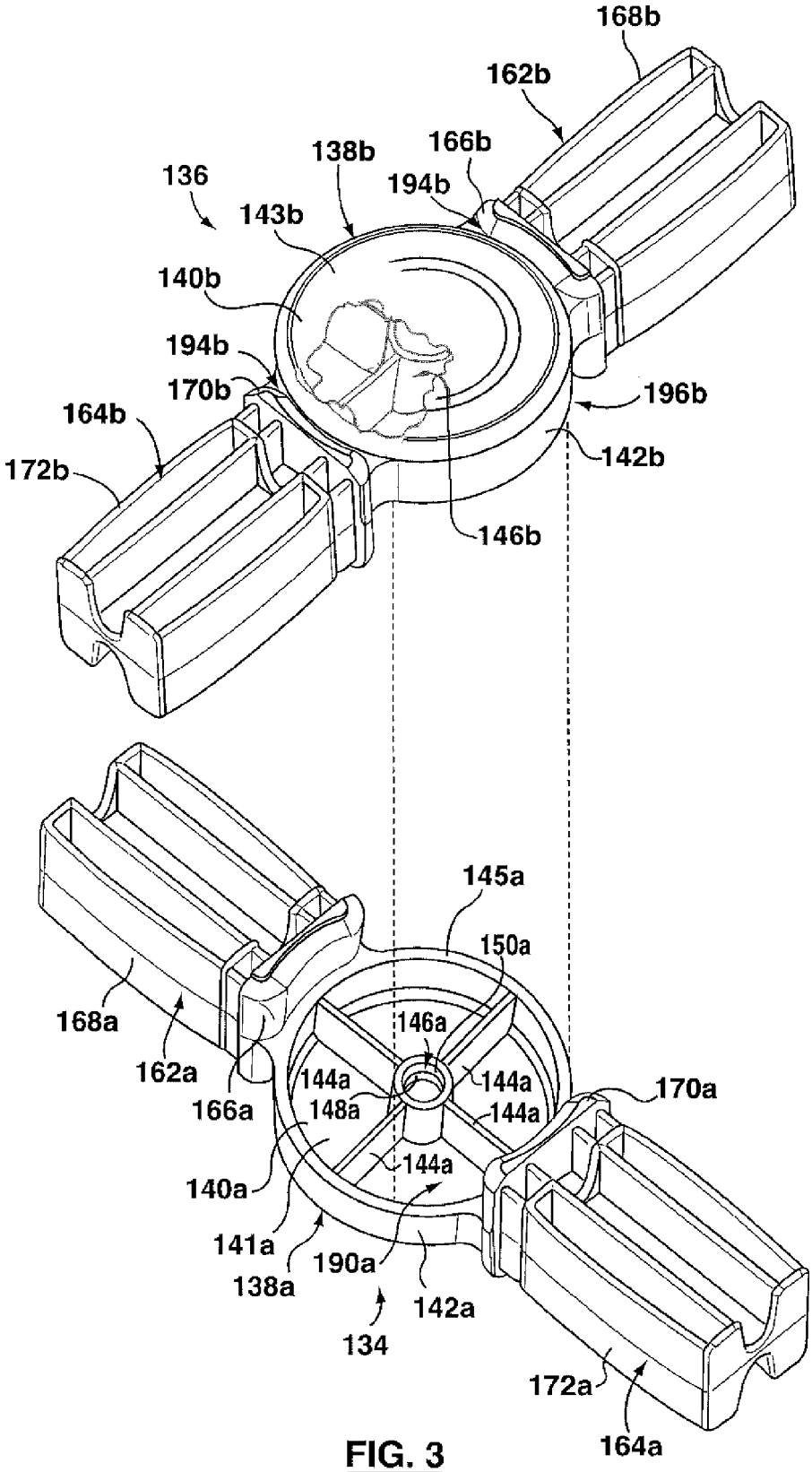
FIG. 3 is an exploded perspective view of a joint member of the baluster assembly of FIG. 2.

Referring to FIG. 3 in the example shown, the joint member 132 comprises a first joint section 134, and a second joint section 136. In the example illustrated, the first joint section 134 is fixed to the first baluster 124 and the third baluster 128, and the second joint section 136 is fixed to the second baluster 126 and the fourth baluster 130. In the example shown, when in the assembled state, the third baluster is fixed relative to the first baluster, and the fourth baluster is fixed relative to the second baluster.

The first joint section 134 is adjustably mounted to the second joint section 136. More specifically, in the example shown, the first joint section 134 is pivotally mounted to the second joint section 136, so that the first baluster 124 is pivotal with respect to the second baluster 126, and the third baluster 128 is pivotal with respect to the fourth baluster 130. By pivoting the first joint section 134 with respect to the second joint section 136, the angle of the first baluster 124 with respect to the second baluster 126 is adjusted, and the angle of the third baluster 128 with respect to the fourth baluster 130 is adjusted. In the example shown, the third 128 and fourth 130 balusters are not adjustable independent of the first 124 and second 126 balusters. Rather, by adjusting the angle of the first baluster 124 with respect to the second baluster 126, the angle of the third baluster 128 with respect to the fourth baluster 130 is adjusted to a corresponding amount. In alternate examples, however, the third 128 and fourth 130 balusters may be adjustable independent of the first 124 and second balusters 126.

In the example shown, the first joint section 134 and the second joint section 136 are substantially identical. For example, the first joint 134 section and the second joint section 136 may be molded from a common mold. Accordingly, for the joint member 132 only the first joint section 134 will be described in detail. Reference numerals ending with the suffix 'a' will be used to label to the features of the first joint section 134. The second joint section has the same features and those are identified by the same reference numerals with the suffix "b".

Figure 4:
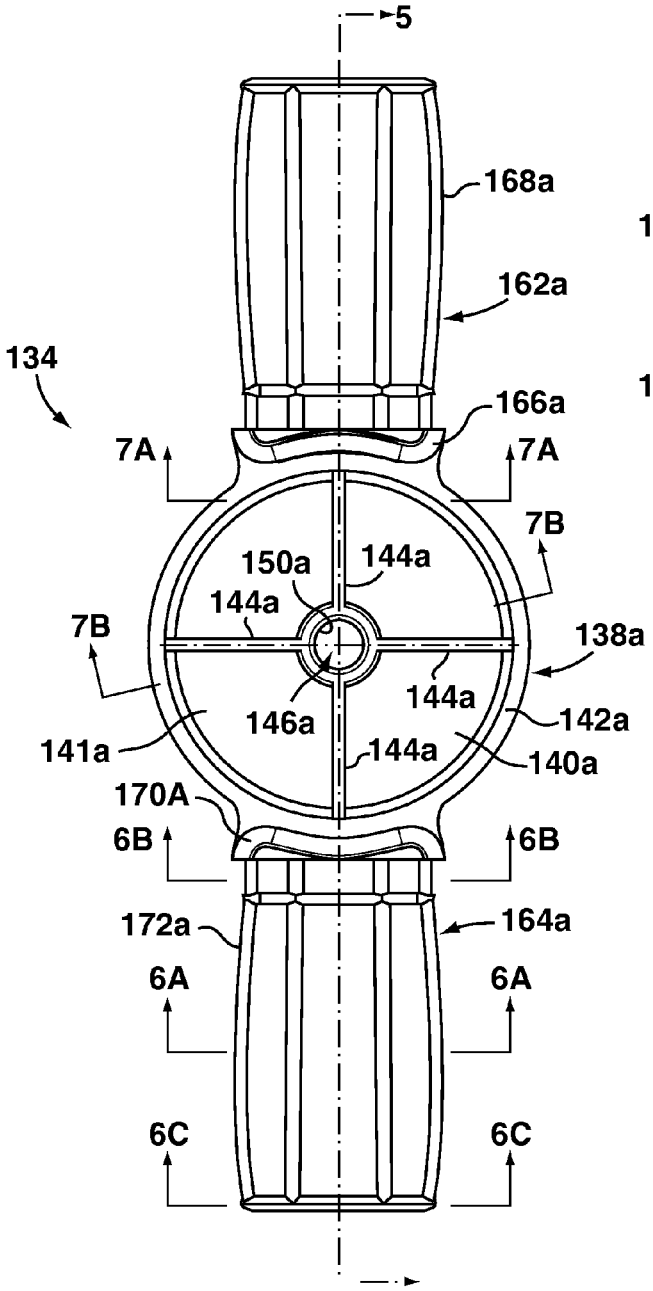
FIG. 4 is a front view of a first joint section of the joint member of FIG. 3.
Figure 5:
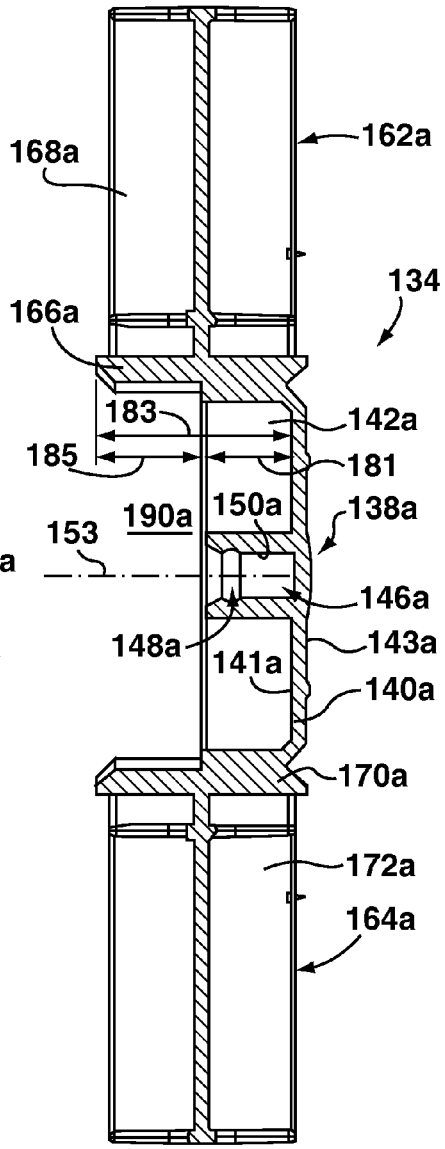
FIG. 5 is a cross sectional view of the first joint section of FIG. 4 taken along lines 5-5.
Figure 6A:
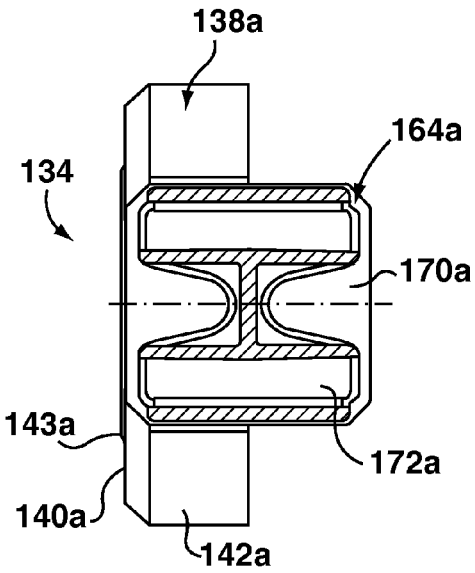
FIG. 6A is a cross section taken along line 6A-6A in FIG. 4.
Figure 6B:
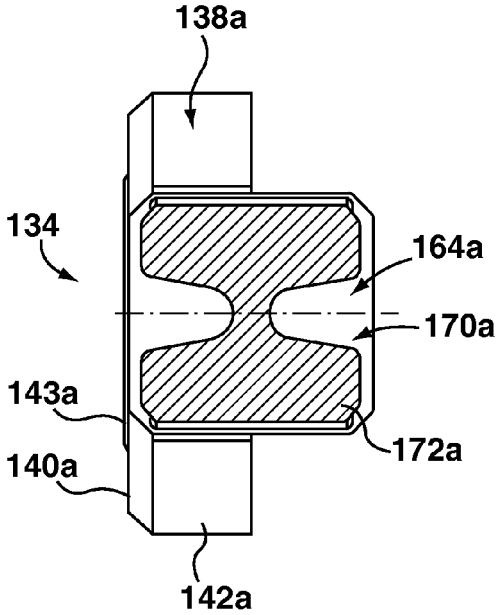
FIG. 6B is a cross section taken along line 6B-6B in FIG. 4
Figure 6C:
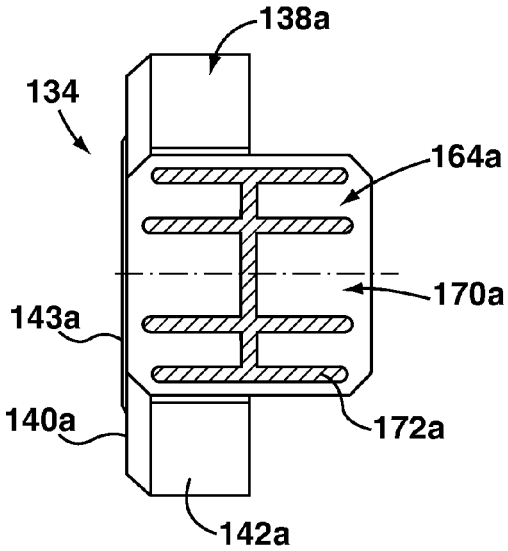
FIG. 6C is a cross section taken along line 6C-6C in FIG. 4.
Figure 7A:
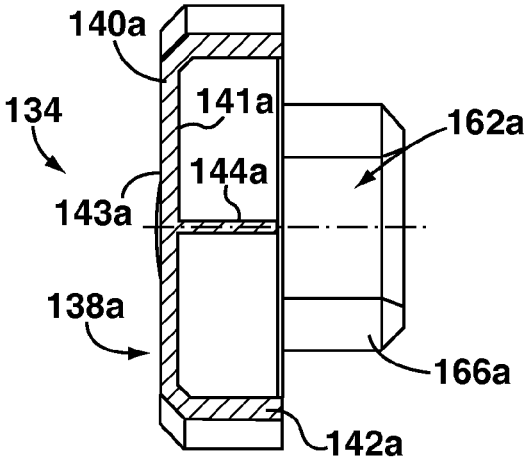
FIG. 7A is a cross section taken along line 7A-7A in FIG. 4.

Referring to FIGS. 3-5, in the example, shown, the first joint section 134 comprises a first hub 138*a*. The first hub 138*a* comprises a generally circular and planar wall 140*a*. The planar wall 140*a* comprises an inner face 141*a*, and an outer face 143*a*. A circumferential wall 142*a* extends generally perpendicularly from the inner face 141*a* of the planar wall 140*a*, at the perimeter of the planar wall 140*a*. A plurality of struts 144*a* extend inwardly from the outer wall 140*a*, along the inner face 141*a*, towards a center of the first hub 138*a*. The struts 144*a* extend between the outer wall 140*a* and the outer surface of centrally located first socket 146*a*. In the example illustrated, the first socket 146*a* extends generally perpendicularly from the inner face 141*a*. The first socket 146*a* comprises a groove 148*a* extending along an inner wall 150*a* thereof, about the perimeter of the socket 146*a*.

Figure 8B:
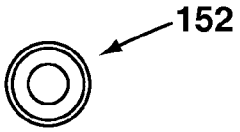
FIG. 8B is a cross section taken along line 8B-8B in FIG. 8A.
Figure 8A:
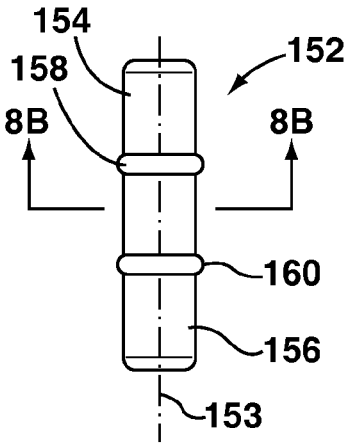
FIG. 8A is a front plan view of a pivot pin.
Figure 7B:
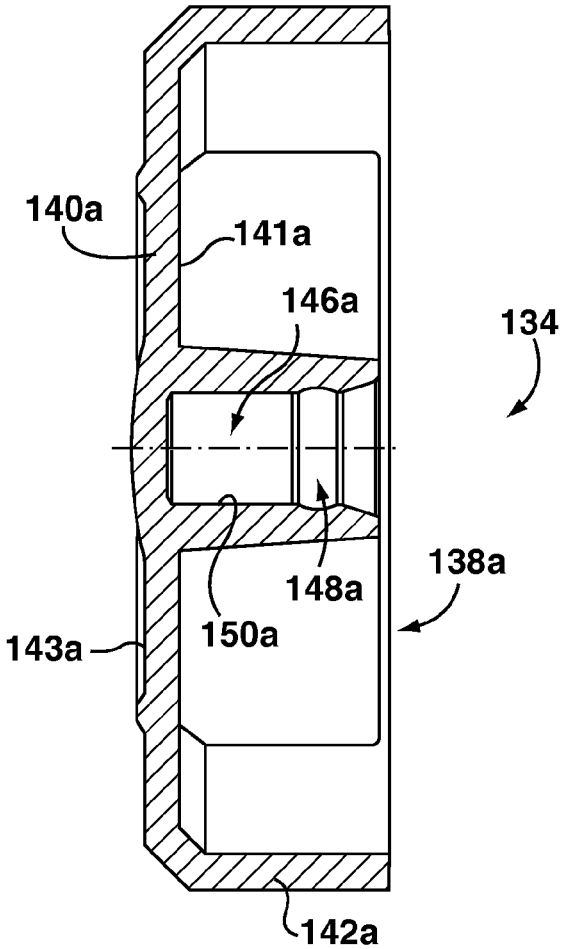
FIG. 7B is a cross section taken along line 7B-7B in FIG. 4.

A pivot pin 152 (shown in FIGS. 8A and 8B) is, in the example illustrated, used to pivotally connect the first joint section 134 to the second joint section 136. The pivot pin 152 comprises a first end section 154, and a second end section 156. The first end section 154 and the second end section 156 each comprise a rib 158, 160, respectively, protruding radially outwardly from an outer surface of the pin 152, and about the perimeter thereof.

To pivotally mount the first joint section 134 to the second joint section 136, the first end section 154 of the pivot pin 152 can be inserted into the first joint section socket 146*a*, such that the rib 158 is received in the groove 148*a*. The engagement of the rib 158 and the groove 148*a* axially retains the pivot pin 152 relative to the first socket 146*a*, while allowing the pivot pin 152 to pivot about the axis 153 relative to the first socket 146*a*. Identically in the example illustrated, the second end section 156 of the pivot pin 152 is inserted into the second socket 146*b*, such that the rib 160 is received in the groove thereof (not shown). The engagement of the tongue 160 and the groove of the second joint section socket securely mounts the pivot pin 152 in the socket, while still allowing the pivot pin 152 to pivot within the socket. In the example shown, the first joint section 134 is adjustably mounted to the second joint 136 section by the pivot pin 152, and each joint section 134, 136 is pivotal about the pivot pin 152, so that the first 124, second 126, third 128, and fourth 130 balusters are each adjustable about a common pivot axis 153.

In the example shown, the pivot pin 152 and the axial spacing of the ribs 158, 160 thereon is configured such that when the pivot pin 152 assembled within the sockets 146, the end face 145*a* of the first circumferential wall 142*a* is positioned closely to (and can slidably abut) the end face 145b of the second circumferential wall 142*b* of the second joint section, For example, the circumferential wall 142*a* of the first joint section 134 may contact the circumferential wall 142*b* of the second joint section 136, so that when the first joint section 134 pivots with respect to the second joint section 136, the circumferential wall 142*a* of the first joint slides along the circumferential wall 142*b* of the second joint section 136. In alternate examples, the circumferential wall 142*a* of the first joint section may be spaced a distance, for example between 0.5 mm and 2 mm, from the circumferential wall 142*b* of the second joint section 136.

With reference to FIGS. 2 and 3, to facilitate mounting the first 124 and third 128 balusters to the first joint section 134, the first joint section 134 can further comprises a first blade 162*a*, and a third blade 164*a*. The first blade 162*a* and the third blade 164*a*, in the example illustrated, each extend outwardly from the first hub 138*a*, and more particularly, from the circumferential wall 142*a*. The first blade 162*a* and the third blade 164*a* extend from opposed sides from the circumferential wall 142*a* (i.e. are spaced 180 degrees apart), and are generally collinear. Further, the first blade 162*a* and the third blade 164*a* extend generally perpendicularly to the socket 146*a* and the pivot axis 153 (FIG. 5). In the example illustrated, the first blade 162*a* comprises a first abutment portion 166*a* adjacent the hub 138*a*, and a first insertion portion 168*a* adjacent the first abutment portion 166*a* and spaced from the hub 138*a*.

With reference to FIG. 2, the first baluster 124 is generally hollow, and has a first end 125, an opposed second end 127, and a central bore (not shown) extending therebetween. The first baluster 124 is slidably received on the first insertion portion 168*a*. The first baluster 124 may be slid onto the first insertion portion 168*a* until the first end 125 of the first baluster 124 contacts the first abutment portion 166*a*. The fit between the baluster 124 and the insertion portion 168*a* can be a press fit.

In the example shown, the first abutment portion 166*a* is shaped and contoured such that when the first end 125 of the first baluster 124 is in contact therewith, the first abutment portion 166*a* and the first baluster 124 have the appearance of a single piece extending from the first hub 138a. That is, the first abutment portion 166a appears as part of the first baluster 124, having an outer surface that is shaped and sized to match that of the baluster 124.

Similarly to the first blade 162*a*, the third blade 164*a* comprises a third abutment portion 170*a* adjacent the first hub 138*a*, and a third insertion portion 172*a* adjacent the second abutment portion 170*a* and spaced from the first hub 138*a*. The third baluster 128 is generally hollow, and has a first end 129, an opposed second end 131, and a central bore (not shown) extending therebetween. The third baluster 128 is slidably received on the third insertion portion 172*a*. The third baluster 126 may be slid onto the third insertion portion 172*a* until the first end 129 of the third baluster 128 contacts the third abutment portion 170*a*. In the example shown, the third abutment portion 170*a* is shaped and contoured such that when the first end 129 of the third baluster 128 is in contact therewith, the third abutment portion 170*a* and the third baluster 128 have the appearance of a single piece, extending from the first hub 138*a*. That is, the third abutment portion 170*a* appears as part of the third baluster 128.

The first 124 and third 128 balusters may be frictionally secured to the first 168*a* and second 172*a* insertion portions, respectively, and/or may optionally be secured to the first 168*a* and third 172*a* insertion portions by, for example, one or more fasteners, or by an adhesive.

To facilitate mounting the second 126 and fourth 130 balusters to the second joint section 136, the second joint section 136 can further comprise a second blade 162*b*, and a fourth blade 164*b*. The second and fourth blades 126*b*, 164*b* are, in the example illustrated, substantially identical to the first blade 162*a* and third blade 164*a* of the first joint section 134, and will therefore not be described in detail herein. The second 126 and fourth 130 balusters are slidably received on the second blade 162*b* and fourth blade 164*b*, respectively, of the second joint section 136.

With reference to FIG. 2, in the example shown, the joint member 132 is configured such that when the first joint section 134 is pivotally mounted to the second joint section 136 and the first 124, second 126, third 128, and fourth 130 balusters are mounted to the first 134 and second joint sections 136, the first 124, second 126, third 128, and fourth 130 balusters are generally coplanar. More specifically, the first 124, second 126, third 128, and fourth 130 balusters each have a front face 174, 176, 178, and 180, respectively, respectively, that faces towards the arrow A1 in FIG. 2, and a rear face, 182, 184, 186, and 188, opposite the front face. When the first joint section 134 is pivotally mounted to the second joint section 136 and the first 124, second 126, third 128, and fourth 130 balusters are mounted to the first 134 and second 136 joint sections, the front faces 174, 178, respectively, of the first 124 and third 128 balusters are generally coplanar with the respective front faces 176, 180 of the second 126 and fourth 130 balusters. Further, the rear faces 182, 186, of the first 124 and third 128 balusters are generally coplanar with the rear faces 184, 188 of the second 126 and fourth 130 balusters.

Referring to FIG. 5, in the example shown, the first hub 138*a* has a central section depth 181. The abutment portions 166*a*, 170*a* each have front-to-back extent generally defining an abutment portion depth 183. The abutment portion depth 183 is generally equal to the front-to-back extent of the balusters (i.e. the spacing between the front faces and rear faces, measured in a direction parallel to the axis 153), and the abutment depth 183 is approximately twice the central section depth 181. When the first 124 and third 128 balusters are mounted to the first 134 joint section, the front faces 172, 176, respectively, of the first 124 and third 128 balusters are generally coplanar with the outer face 143*a* of the planar wall 140*a* of the first hub 138*a*. A recess 190*a* is formed within the first joint section 134, between the first abutment portion 166*a* and the second abutment portion 170*a*. When the second and fourth balusters 126, 130 are mounted to the blades 162*b*, 164*b* of the second joint section 136, the respective rear faces 184, 188 are generally coplanar with the outer surface 143*b* of the planar wall 140*b* of the second hub 138*b*, and a recess is formed within the second joint section 136, between the second abutment portion 166*b* and the fourth abutment portion 170*b*. As the abutment portion depth 183 is approximately twice the central section depth 181, each recess has a recess depth 185 that is approximately equal to the central section depth 181.

Again referring to FIG. 2, when the first joint section 134 is mounted to the second joint section 136, the first hub 138*a* of the first joint section 134 is received in the recess of the second joint section 136, and the second hub 138*b* of the second joint section 136 is received in the recess 190*a* of the first joint section 134. The recess depth 185 is approximately equal to the central section depth 181, and when the hub 138*a* of the first joint section 134 is received in the recess of the second joint section 136, the front faces 174, 178, of the first 124 and third 128 balusters are generally coplanar with the front faces 176, 180 of the second 126 and fourth 130 balusters. The rear faces 182, 186, of the first 124 and third 128 balusters are generally coplanar with the rear faces 184, 188 of the second 126 and fourth 130 balusters.

It will be appreciated that, in the example shown, in order for the first hub 138*a* of the first joint section 134 to be received in the recess of the second joint section 136, and the second hub 138*b* of the second joint section 136 to be received in the recess 190*a*, the respective axes of the blades of the first 134 and second 136 joint sections must be positioned at an angle with respect to each other (i.e. in non-overlapping relation), so that the first blade 162*a* and second blade 164*a* of the first joint section 134 are positioned rotationally between the first blade 162*b* and second blade 164*b* of the second joint section 136.

Referring still to FIG. 2, in the example shown, the first 166*a* and third 170*a* abutment portions of the first joint section 134 further comprise a contoured portion 194*a*, and the second 166*b* and fourth 170*b* abutment portions of the second joint section 134 further comprise a contoured portion 194*b* (shown in FIG. 3). The contoured portion 194*a* of the first joint section 134 is configured such that when the baluster assembly 122 is viewed from a direction facing the planar wall 140*a* of the first joint section 134 (i.e. viewed along arrow A1), the second joint section 136 and the first joint section 134 appear substantially identical. That is, as a gap 155 will exist between the first 166*b* and second 170*b* abutment portions of the second joint section 136 and the first hub 138*a* of the first joint section 134, the first 166*a* and second

170*a* abutment portions of the first joint section 134 are contoured such that it appears as though a gap also exists between the first 166*a* and second 170*a* abutment portions of the first joint section 134 and the first hub 138*a* of the first joint section 134. The contoured portion 194*b* of the second joint section 136 may be configured in a substantially identical manner to the contoured portion 196*a* of the first joint section 134.

Figure 9:
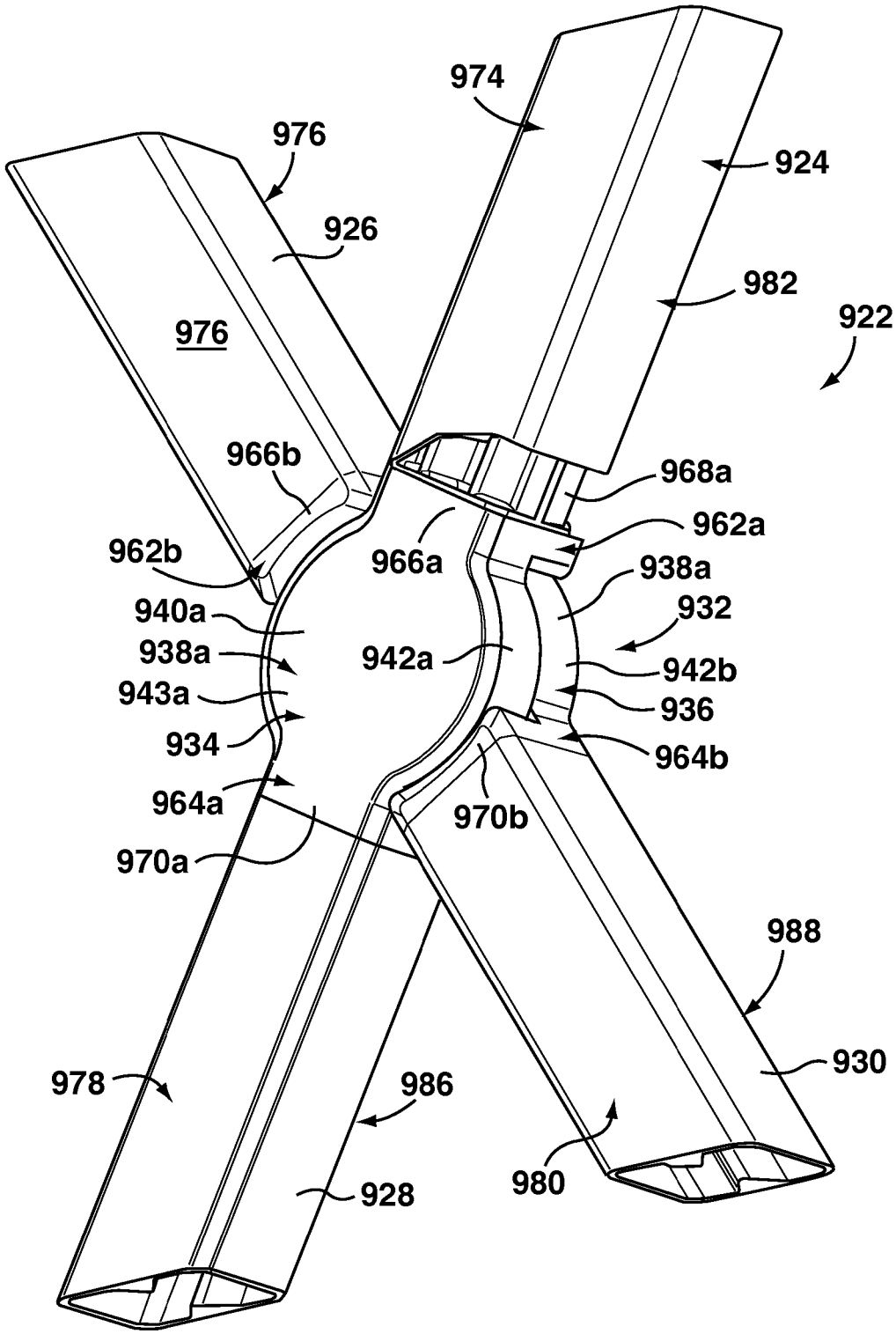
FIG. 9 is a perspective partial cutaway view of another baluster assembly.

Referring now to FIG. 9, another example of a baluster assembly 922 is shown, having similar features as the baluster assembly 122 identified by like reference characters, incremented by 800. The baluster assembly 922 does not include a contoured portion similar to the contoured portion 194. Accordingly, when the baluster assembly 922 is viewed from a direction facing the planar wall 940*a* of the first joint section 934, the second joint section 936 and the first joint section 934 do not appear substantially identical.

Referring now to FIGS. 10 to 13, further alternate embodiments of an adjustable baluster assembly 1022, 1122, 1222, 1322 are shown. In FIGS. 10 to 13, like numerals are used to refer to like elements as in FIG. 1, with the first digit incremented to refer to the Figure number.

Figure 10:
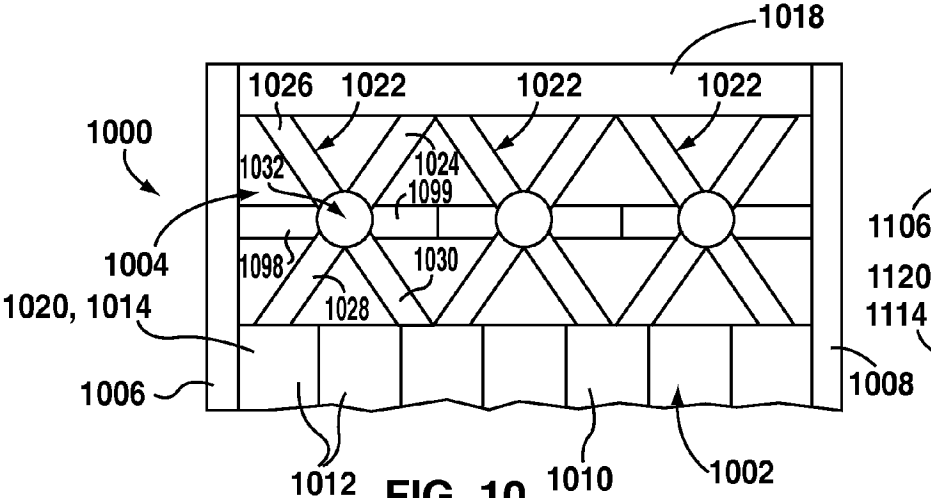
FIG. 10 is a front view of a fence section comprising a plurality of alternate adjustable baluster assemblies.

In the embodiment shown in FIG. 10, each adjustable baluster assembly 1022 further comprises a fifth 1098 and a sixth 1099 baluster, which are pivotally mounted to the first 1024, second 1026, third 1028, and fourth 1030 balusters.

Figure 11:
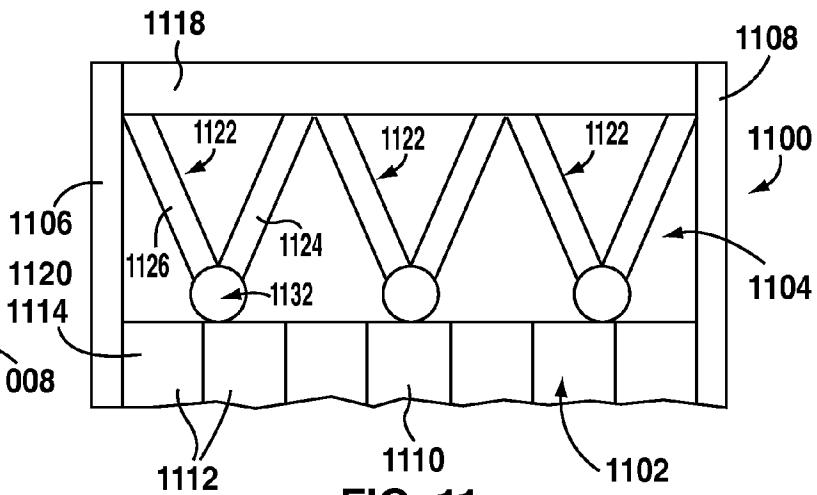
FIG. 11 is a front view of an alternate fence section comprising a plurality of alternate adjustable baluster assemblies.

In the embodiment shown in FIG. 11, each baluster assembly 1122 comprises only a first 1124 and a second 1126 baluster. Further, in this embodiment, the pivot axis is vertically off centre with respect to the spacing between upper rail 118 and lower rail 120, and is adjacent the lower rail 120.

Figure 12:
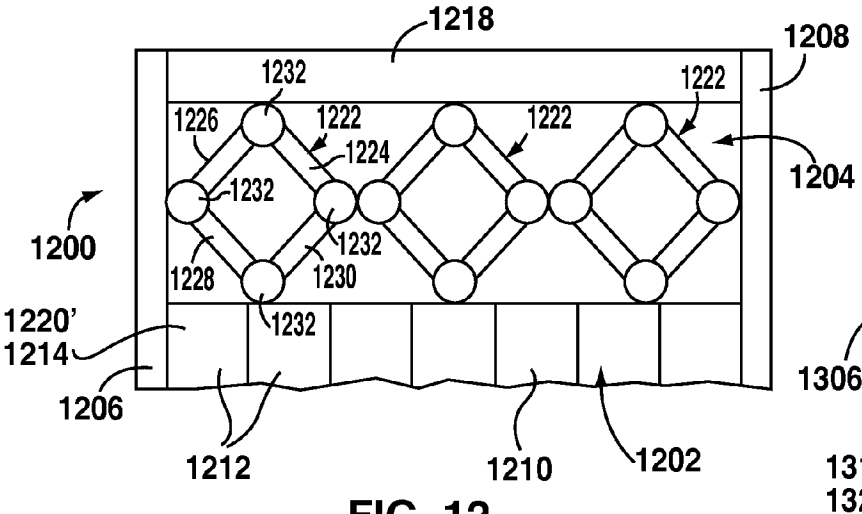
FIG. 12 is a front view of another alternate fence section comprising a plurality of alternate adjustable baluster assemblies.

In the embodiment shown in FIG. 12, each baluster assembly 1222 comprises a first 1224, second 1226, third 1228, and fourth 1230 baluster. However, the baluster assembly 1222 comprises four joint members 1232, and the balusters 1224, 1226, 1228 and 1230 are adjustably mounted together to form a diamond shaped baluster assembly 1222, rather than the X-shape of the baluster assembly 122 of FIG. 1.

Figure 13:
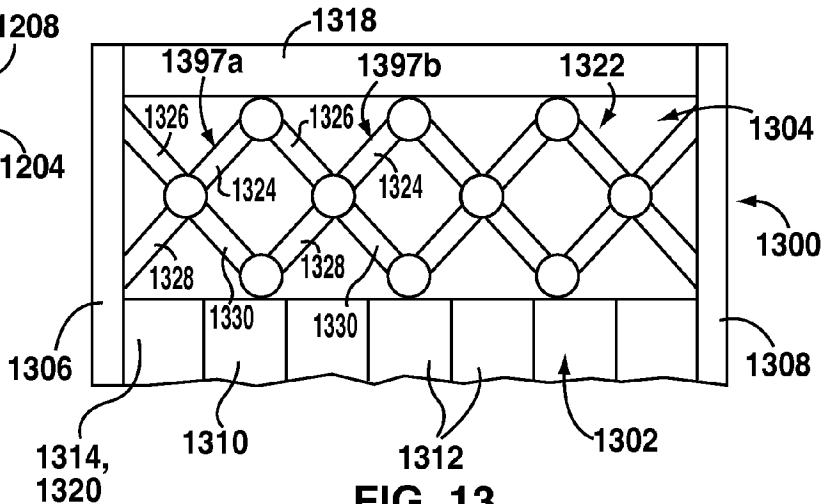
FIG. 13 is a front view of another alternate fence section comprising a plurality of alternate adjustable baluster assemblies.

In the embodiment shown in FIG. 13, the baluster assembly 1322 is similar to the baluster assembly 122 of FIG. 1. However, rather than providing a plurality of adjacent baluster assemblies 122, one common baluster assembly 1322 is provided. That is, a plurality of baluster sub-assemblies 1397 is provided. The first baluster 1324 of one baluster sub-assembly 1397*a* is adjustably mounted to the second baluster 1324 of an adjacent baluster sub-assembly 1397*b*.

Figure 14:
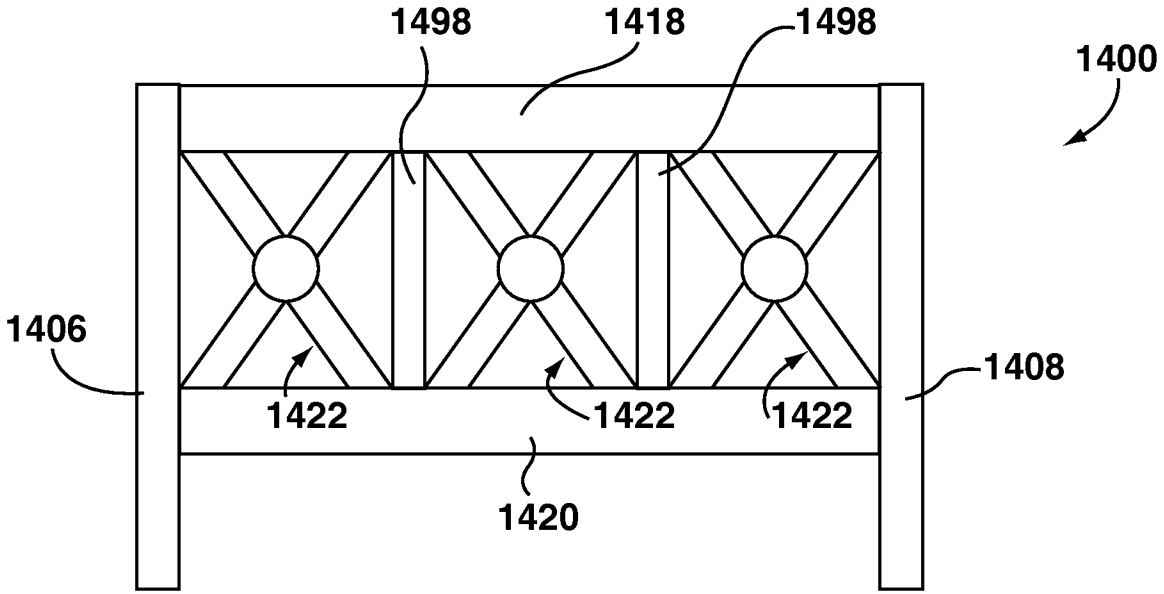
FIG. 14 is a front view of another alternate fence section comprising a plurality of alternate adjustable baluster assemblies.

Referring now to FIG. 14, an alternate fence section 1400 is shown. In FIG. 14, like numerals are used to refer to like elements as in FIG. 1, with the first digit incremented to refer to the Figure number. The fence section 1400 is similar to the fence section 100, however the fence section 1400 is a section of a decorative rail, rather than a section of an outdoor fence. Similarly to the fence section 100 of FIG. 1, the fence section 1400 includes first 1406 and second 1408 side posts, and an upper rail 1418 and a lower rail 1420. A plurality of baluster assemblies 1422, as described hereinabove with respect to FIGS. 1 to 8, are mounted between the upper rail 1418 and the lower rail 1420. Further, the fence section includes a plurality of vertical posts 1498, each of which is mounted horizontally between two adjacent baluster assemblies 1422, and vertically between the upper rail 1418 and the lower rail 1420. The vertical posts 1498 may be provided for decorative purposes, and/or may provide structural support to the rail.

In any of the above examples, the baluster assembly may be made from any suitable material, such as a plastic. For example, the first 134 and second 136 joint sections may be made from a molded plastic. Further, the balusters 124-130 may be made from an extruded plastic.

In use, as mentioned hereinabove, the adjustable baluster assemblies described hereinabove may be mounted in a fence section, in order to provide the fence section with a desired height and width, or a desired appearance. In general, a method of assembling a fence section may comprise providing an adjustable baluster assembly comprising a first baluster and a second baluster. Such a baluster assembly may include any of baluster assemblies described hereinabove. The method may further comprise adjusting an angle of the first baluster with respect to the second baluster. Optionally, depending on the specific configuration of the baluster assembly, the method may further include adjusting an angle of any additional balusters. The method further comprises mounting the baluster assembly between a horizontally extending upper rail of the fence section and a horizontally extending lower rail of the fence section.

An exemplary method of assembling the upper section 104 of the fence section 100 using baluster assembly 122 will presently be described. It will be appreciated that in alternate examples, the order of the steps described may be modified.

In order to assemble the upper section 104 of the fence section 100, the horizontally extending lower rail 120 may first be mounted between the first side post 106 and the second side post 108. For example, one or more fasteners (not shown) may be used to secure the lower rail 120 between the first side post 106 and the second side post 108. The horizontally extending upper rail 118 may then be mounted between the first side post 106 and the second side post. The upper rail 118 may be positioned at any suitable height from the lower rail. For example, the user may desire for the fence section to have a relatively tall height, as shown in FIG. 1A, or a relatively short height, as shown in FIGS. 1B and 1C. If the user desires for the fence section to have a relatively short height, as shown in FIGS. 1B and 1C, the user may position the upper rail 118 a distance from the lower rail that is equal to third height 169. The third height 169 may be, for example, about 24 inches.

One or more baluster assemblies 122 may then be obtained, and an angle of the first baluster 124 with respect to the second baluster 126 may be selected. The angle may be selected depending on a desired appearance of the fence section 100. For example, a user may desire for the fence section 100 to appear as shown in FIG. 1B, or as shown in FIG. 1C. If the user desires for the fence section 100 to appear as shown in FIG. 1C, the user may select the angle of the first baluster 124 with respect to the second baluster 126, and the third baluster 128 with respect to the fourth baluster 130, such that the angles are equal to the fifth 161 and sixth 163 angles, respectively. For example, the fifth 161 and sixth 163 angles may each be about 60 degrees, as shown in FIG. 1C.

When the angle has been selected, the user may then optionally adjust the length of the balusters 124-126, so that height of the baluster assembly 122, after the angles have been adjusted, is equal to the third height 169. For example, the user may determine the required value of the third length 165 based on the value of the fifth angle 161 and the third height 169. This may be done by performing a calculation, or by visual inspection. For example, if the third height 169 has been selected to be 24 inches, and the fifth angle 161 has been selected to be 60 degrees, then the required value of the third distance 167 may be determined to be 12 inches Accordingly, a user may adjust the third length 165 of the first baluster 124 and the third baluster 126 such that the third distance 167 is 12 inches. For example, if the baluster assembly 122 is sold having a distance between the second end 127 of the first baluster 124 and the second end 131 of the third baluster 128 of 14 inches, a user may cut 1 inch from each of the second end 127 of the first baluster 124 and second end 131 of the third baluster 128. For example, the user may cut the balusters using a saw. The user may repeat this for the second baluster 126 and the fourth baluster 130.

The user may cut the balusters 124-130 such that, after the angles have been adjusted, the second end 127, 131, 133, 135 of each of the balusters is generally horizontal. For example, if 161 is 60°, then the second end 127 of the first baluster 124 may be cut at an angle of 60° with respect to a longitudinal axis of the first baluster 124, so that the second end 127 of the first baluster 124 is horizontal.

It will be appreciated that it may not be necessary to adjust the length of the balusters 124-130. For example, the user may select the angle of the first baluster 124 with respect to the second baluster 126 based on the distance between the second end 127 of the first baluster 124 and the second end 131 of the third baluster 128, as sold. That is, rather than adjusting the length 165 based on a selected angle, the angle may be adjusted based on a predetermined length 165.

When the length 165 of the balusters has been adjusted, the angle of the first baluster 124 with respect to the second baluster 126 may be adjusted, and the baluster assembly 122 may be mounted between the upper rail 118 and the lower rail 120. These two steps may optionally be carried out concurrently. For example, the user may position the baluster assembly 122 between the upper rail 118 and the lower rail 120, such that the second ends 131, 135, respectively of the third 128 and fourth 130 balusters are seated on the lower rail 120. The second ends 131, 135 of the third 128 and fourth 130 balusters may then be secured to the lower rail 120. For example, a fastener (not shown) may be used to secure the second ends 131, 135 of the third 128 and fourth 130 balusters to the lower rail. For example, a screw may be screwed through the second end 131 of the third baluster 128 and into the lower rail 120, to secure the second end 131 to the lower rail. Alternately, the lower rail may comprise a groove 1500 (shown in F*igure* 15) extending along the top surface thereof, in which the second ends 131, 135 of the third 128 and fourth 130 balusters may be snapably received.

The angle of the first baluster 124 with respect to the second baluster 126, and the third baluster 128 with respect to the fourth baluster 130 may then be adjusted. For example, the first baluster 124 and second baluster 126 may be lifted away from the lower rail 120, until the second ends 127, 133, respectively, of the first baluster 124 and second baluster 126 contact the upper rail 118, As the third 128 and fourth 130 balusters are secured to the lower rail 120, lifting the first baluster 124 and second baluster 126 will cause the first baluster 124, second baluster 126, third baluster 128, and fourth baluster 130 to pivot about the pivot pin 152, and cause the angle of the first baluster 124 to be adjusted with respect to second baluster 126, and the angle of the third baluster 128 to be adjusted with respect to the fourth baluster 130. The second ends 127, 133, respectively, of the first 124 and second 126 balusters may then be secured to the upper rail 120, For example, a fastener (not shown) may be used to secure the second ends 127, 133 of the first 124 and second 126 balusters to the upper rail 120, or the upper rail 120 may comprise a groove extending along the bottom surface thereof (corresponding to the groove 1500 shown in FIG. 15), in which the second ends 127, 133, of the first 124 and second 126 balusters may be snapably received.

Any additional baluster assemblies 122, such as the four baluster assemblies shown in FIG. 1C, may then be assembled into the fence section 100.

It will be appreciated that the adjustable baluster assembly described herein may be assembled into an alternate fence section. For example, an alternate fence section may include only a single central section, rather than an upper section and a lower section, and the adjustable baluster assembly may be assembled into the central section. In further alternate examples, the adjustable baluster assembly may be assembled into another type of barrier other than a fence, such as a railing.

The invention claimed is:

1. A fence section comprising:

a) a horizontally extending upper rail;

b) a horizontal extending lower rail parallel to, and spaced at a lower elevation than, the upper rail; and c) at least one adjustable baluster assembly between the upper rail and the lower rail and mounted to the upper rail and the lower rail, the adjustable baluster assembly comprising a first baluster and a second baluster each extending generally radially outwardly from a common pivot axis, the first baluster adjustably coupled to the second baluster such that an angle of the first baluster with respect to the second baluster is adjustable about the common pivot axis, a third baluster extending generally radially outwardly from the common pivot axis and adjustably coupled to the second baluster such that an angle of the third baluster with respect to the second baluster is adjustable by rotation of the third baluster about the common pivot axis; and a fourth baluster extending generally radially outwardly from the common pivot axis and adjustably coupled to the first baluster such that an angle of the fourth baluster with respect to the first baluster is adjustable by rotation of the fourth baluster about the common pivot axis, wherein the first, second, third and fourth balusters are pivotally mounted together by a joint member, the joint member comprising;

i) a first joint section comprising a first hub having a first socket, a first blade extending from the first hub perpendicular to the common pivot axis, and a third blade extending from the first hub opposite the first blade and perpendicular to the common pivot axis;

ii) a second joint section comprising a second hub having a second socket aligned with the first socket, a second blade extending from the second hub perpendicular to the common pivot axis, and a fourth blade extending from the second hub opposite the second blade and perpendicular to the common pivot axis; and iii) a pivot pin received in the first socket and the second socket, the pivot pin extending along the common pivot axis and coupling together the first and second joint sections, wherein the upper rail has an underside surface directed towards the lower rail, and the lower rail has an upperside surface directed towards the upper rail, and wherein the first baluster and the second baluster comprise first and second inner ends proximate the joint member and opposed first and second outer ends spaced apart from the respective first and second inner ends, and wherein the third baluster and the fourth baluster comprise third and fourth inner ends proximate the joint member and opposed third and fourth outer ends spaced apart from the respective third and fourth inner ends, and wherein the first and second outer ends are joined to the upperside surface of the lower rail at selected lower rail attachment locations, and wherein the third and fourth outer ends are joined to the underside surface of the upper rail at selected upper rail attachment locations generally opposite the lower rail attachment locations, wherein when the fence section is assembled, the first baluster and second baluster are fixed relative to the upper rail, and, wherein the first outer end of the first baluster is non-rotatably connected to the underside of the upper rail.

2. The fence section of claim 1, wherein when the fence section is assembled, rotation of the first baluster, second baluster, third baluster and fourth baluster about the common pivot axis is inhibited by at least one of the upper rail and the lower rail.

3. The fence section of claim 1, wherein the common pivot axis extends horizontally and perpendicular to the upper rail and lower rail.

4. The fence section of claim 3, wherein the common pivot axis is disposed at an elevation approximately midway between the upper rail and the lower rail.

5. The fence section of claim 1, wherein the first baluster is slidably received on the first blade, the second baluster is slidably received on the second blade, the third baluster is slidably received on the third blade, and the fourth baluster is slidably received on the fourth blade.

6. The fence section of claim 1, wherein the upperside and underside surfaces are generally horizontal, and wherein the outer ends of the balusters are mitered to bear in flush engagement with the respective upperside and underside surfaces when joined thereto.

7. The fence section of claim 1, wherein the upperside surface of the lower rail comprises a first groove extending along its length, and wherein the outer ends of the first and second balusters are received in the first groove.

8. The fence section of claim 1, wherein the underside surface of the upper rail comprises a second groove extending along its length, and wherein the outer ends of the third and fourth balusters are received in the second groove.

9. The fence section of claim 1, wherein the first hub is substantially identical to the second hub.

10. The fence section of claim 9, wherein the first hub is an integral, one-piece injection molded member, and the second hub is an integral one-piece injection molded member.

11. The fence section of claim 1, wherein the first hub comprises a first endwall, having a first outer face and an opposed first inner face, and a first sidewall extending from the periphery of the first inner face, and wherein the first socket extends between a socket first end adjacent the first inner face and a second socket end spaced apart from the first inner face, the socket first end being covered by a portion of the inner face and the socket second end being open to receive the pivot pin.

12. The fence section of claim 11, wherein the second hub comprises a second endwall, having a second outer face and an opposed second inner face, and a second sidewall extending from the periphery of the second inner face, and wherein the second socket extends from the second inner face, and when the second hub is connected to the first hub so that the first inner face opposes the second inner face and the pivot pin is contained between the first inner face and the second inner face, and is not accessible from the first outer face or the second outer face.

13. The fence section of claim 1, wherein the first socket comprises a first socket engagement member and the pivot pin comprises a complimentary first pin engagement member, engagement between the first socket engagement member and the first pin engagement member axially securing the pivot pin within the first socket and permitting relative rotation therebetween.

14. The fence section of claim 13, wherein the first socket engagement member comprises a groove in a sidewall of the first socket, and the first pin engagement member comprises a tongue member extending radially outward from the pivot pin.

15. The fence section of claim 1, wherein the balusters each have respective front faces that are generally coplanar and disposed in a first plane, and respective rear faces that are generally coplanar and disposed in a second plane, the first plane spaced horizontally apart from the second plane.

16. The fence section of claim 15, wherein the upper rail and lower rail each have respective first and second lateral side edges spaced horizontally apart from each other, and wherein the first and second planes are disposed laterally inboard of the first and second side edges of the upper and lower rails.

17. The fence section of claim 15, wherein a plurality of said adjustable baluster assemblies are disposed between the upper and lower rails.

18. The fence section of claim 15 wherein at least two baluster assemblies are disposed side-by-side lengthwise along the upper and lower rails.

19. The fence section of claim 18, wherein a generally vertical fixed baluster is disposed between adjacent ones of the at least two baluster assemblies, the fixed baluster having an upper end joined to the upper rail and a lower end joined to the lower rail.

20. The fence section of claim 1, wherein the first baluster defines a first baluster axis, the second baluster defines a second baluster axis and the first baluster axis and the second baluster axis intersect each other at the common pivot axis.

21. The fence section of claim 20, wherein the third baluster defines a third baluster axis, the fourth baluster defines a fourth baluster axis and the third baluster axis and the fourth baluster axis intersect each other at the common pivot axis.

22. The fence section of claim 21, wherein the first baluster axis is coaxial with the third baluster axis.

23. The fence section of claim 20, wherein the angle between the first baluster and second baluster is adjustable so that the first baluster is movable between a first position and a second position relative to the second baluster, and wherein the first baluster axis intersects the second baluster axis at the common pivot axis when the first baluster is in the first position and when the first baluster is in the second position and when the first baluster is moving between the first and second positions.

24. The fence section of claim 1, wherein the first baluster comprises a first unitary, extruded plastic elongate member.

25. The fence section of claim 24, wherein the first extruded plastic elongate member is hollow.

* * * * *

UNITED STATES PATENT AND TRADEMARK OFFICE

CERTIFICATE OF CORRECTION

PATENT NO. : 8,579,263 B2
APPLICATION NO. : 12/966600
DATED : November 12, 2013
INVENTOR(S) : Gabriel Petta It is certified that error appears in the above-identified patent and that said Letters Patent is hereby corrected as shown below:

In the Claims:

In Claim 1, column 14, line 13, delete “horizontal” and substitute --horizontally--.

In Claim 18, column 16, line 28, delete “15 wherein” and substitute --15, wherein--.

Signed and Sealed this
Thirteenth Day of May, 2014

Michelle K. Lee

Michelle K. Lee
*Deputy Director of the United States Patent and Trademark Office*